US007980207B2

(12) United States Patent
Takahashi et al.

(10) Patent No.: US 7,980,207 B2
(45) Date of Patent: Jul. 19, 2011

(54) MULTI-LINK ENGINE

(75) Inventors: Naoki Takahashi, Yokohama (JP); Masayuki Tomita, Fujisawa (JP); Kenshi Ushijima, Kamakura (JP); Koji Hiraya, Yokohama (JP); Hirofumi Tsuchida, Yokosuka (JP); Shunichi Aoyama, Yokosuka (JP)

(73) Assignee: Nissan Motor Co., Ltd., Yokohama (JP)

( * ) Notice: Subject to any disclaimer, the term of this patent is extended or adjusted under 35 U.S.C. 154(b) by 379 days.

(21) Appl. No.: 12/255,370

(22) Filed: Oct. 21, 2008

(65) Prior Publication Data

US 2009/0107468 A1 Apr. 30, 2009

(30) Foreign Application Priority Data

Oct. 26, 2007 (JP) ..... 2007-279395
Oct. 26, 2007 (JP) ..... 2007-279401
Oct. 30, 2007 (JP) ..... 2007-281459
Jun. 20, 2008 (JP) ..... 2008-161633

(51) Int. Cl.
*F02B 75/04* (2006.01)

(52) U.S. Cl. ..... 123/48 B; 123/48 R; 123/78 R; 123/78 BA

(58) Field of Classification Search ..... 123/48 R, 123/48 B, 78 R, 78 BA, 78 E, 78 F, 197.4
See application file for complete search history.

(56) References Cited

U.S. PATENT DOCUMENTS 6,390,035 B2 5/2002 Moteki et al.
6,505,582 B2 1/2003 Moteki et al.
6,877,463 B2 * 4/2005 Moteki et al. ..... 123/48 B
7,117,838 B2 10/2006 Aoyama et al.
7,363,902 B2 4/2008 Ushijima et al.
2003/0209213 A1 * 11/2003 Moteki et al. ..... 123/48 B
2006/0102116 A1 * 5/2006 Maezuru et al. ..... 123/78 E
2007/0204829 A1 * 9/2007 Takahashi et al. ..... 123/197.4

FOREIGN PATENT DOCUMENTS

JP 2001-227367 A 8/2001
JP 2002-061501 A 2/2002
JP 2005-147068 A 6/2005
JP 2006-183595 A 7/2006

OTHER PUBLICATIONS

An English translation of the Chinese Office Action of corresponding Chinese Application No. 200810173229.X, dated Apr. 6, 2010.

* cited by examiner

*Primary Examiner* — Michael Cuff
*Assistant Examiner* — Hung Q. Nguyen
(74) *Attorney, Agent, or Firm* — Global IP Counselors, LLP

(57) ABSTRACT

A multi-link engine has a piston that moves inside a cylinder. A piston pin connects the piston to an upper link, which is connected to a lower link. A crank pin of a crankshaft supports the lower link thereon. The lower link is pivotally connected to one end of a control link, which is connected at another end to the engine block body by a control shaft. The control shaft is lower than a crank journal of the crankshaft, and disposed on a first side of a plane that is parallel to a cylinder center axis and that contains a center rotational axis of the crank journal. The cylinder center axis is located on a second (i.e., opposite the first side) plane. The control link has a center axis that is parallel to the cylinder center axis when the piston is near top and bottom dead centers.

7 Claims, 9 Drawing Sheets

UPWARD TRIANGLE

DOWNWARD TRIANGLE

LINEAR TYPE

MULTI-LINK ENGINE

CROSS-REFERENCE TO RELATED APPLICATIONS

This application claims priority to Japanese Patent Application Nos. 2007-279395, filed on Oct. 26, 2007, 2007-279401, filed on Oct. 26, 2007, 2007-281459, filed on Oct. 30, 2007 and 2008-161633, filed on Jun. 20, 2008. The entire disclosures of Japanese Patent Application Nos. 2007-279395, 2007-279401, 2007-281459 and 2008-161633 are hereby incorporated herein by reference.

BACKGROUND OF THE INVENTION

1. Field of the Invention

The present invention generally relates to a multi-link engine. More specifically, the present invention relates to a link geometry for a multi-link engine.

2. Background Information

Engines have been developed in which a piston pin and a crank pin are connected by a plurality of links (such engines are hereinafter called multi-link engines). For example, a multi-link engine is disclosed in Japanese Laid-Open Patent Publication No. 2002-61501. A multi-link engine is provided with an upper link, a lower link and a control link. The upper link is connected to a piston, which moves reciprocally inside a cylinder by a piston pin. The lower link is rotatably attached to a crank pin of a crankshaft and connected to the upper link with an upper link pin. The control link is connected to the lower link with a control link pin for rocking about a control shaft pin of a control shaft. The control shaft has a shaft-controlling axle that is rotatably supported between a main bearing cap and a control shaft support cap that is fastened to the main bearing cap by at least one bolt. An example of a multi-link engine that includes such an arrangement is disclosed in Japanese Laid-Open Patent Publication No. 2001-227367.

In view of the above, it will be apparent to those skilled in the art from this disclosure that there exists a need for an improved multi-link engine. This invention addresses this need in the art as well as other needs, which will become apparent to those skilled in the art from this disclosure.

SUMMARY OF THE INVENTION

It has been discovered that with the multi-link engine, as discussed above, the loads acting on the piston due to combustion pressure and inertia are transmitted to the shaft-controlling axle of the control shaft through the links. If the load acts to push the shaft-controlling axle of the control shaft downward, then the control shaft support cap of the control shaft could become separated and misaligned relative to the main bearing cap, e.g., resulting in a so-called "open mouth" state.

The present invention was conceived in view of this existing problem. One object is to provide a link geometry for a multi-link engine that can reliably prevent the control shaft support cap from becoming misaligned with respect to the engine block body.

In view of the above, a multi-link engine is provided that basically comprises an engine block body, a control shaft, a crankshaft, a piston, an upper link, a lower link and a control link. The engine block body includes at least one cylinder. The control shaft is rotatably supported on the engine block body by a control shaft support cap that is fastened to the engine block body by at least one bolt. The crankshaft includes a crank pin. The piston is operatively coupled to the crankshaft to reciprocally move inside the cylinder of the engine. The upper link is rotatably connected to the piston by a piston pin. The lower link is rotatably connected to the crank pin of the crankshaft and is rotatably connected to the upper link by an upper link pin. The control link is rotatably connected at one end to the lower link by a control link pin and rotatably connected at another end to the control shaft. The control shaft is positioned lower than a crank journal of the crankshaft and disposed on a first side of a plane that is parallel to the center axis of the cylinder and that contains a center rotational axis of the crank journal, while the center axis of the cylinder is located on a second side of the plane with the first side of the plane being opposite from the second side of the plane. The control link has a center axis that is parallel to the center axis of the cylinder when the piston is near top dead center and when the piston is near bottom dead center.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
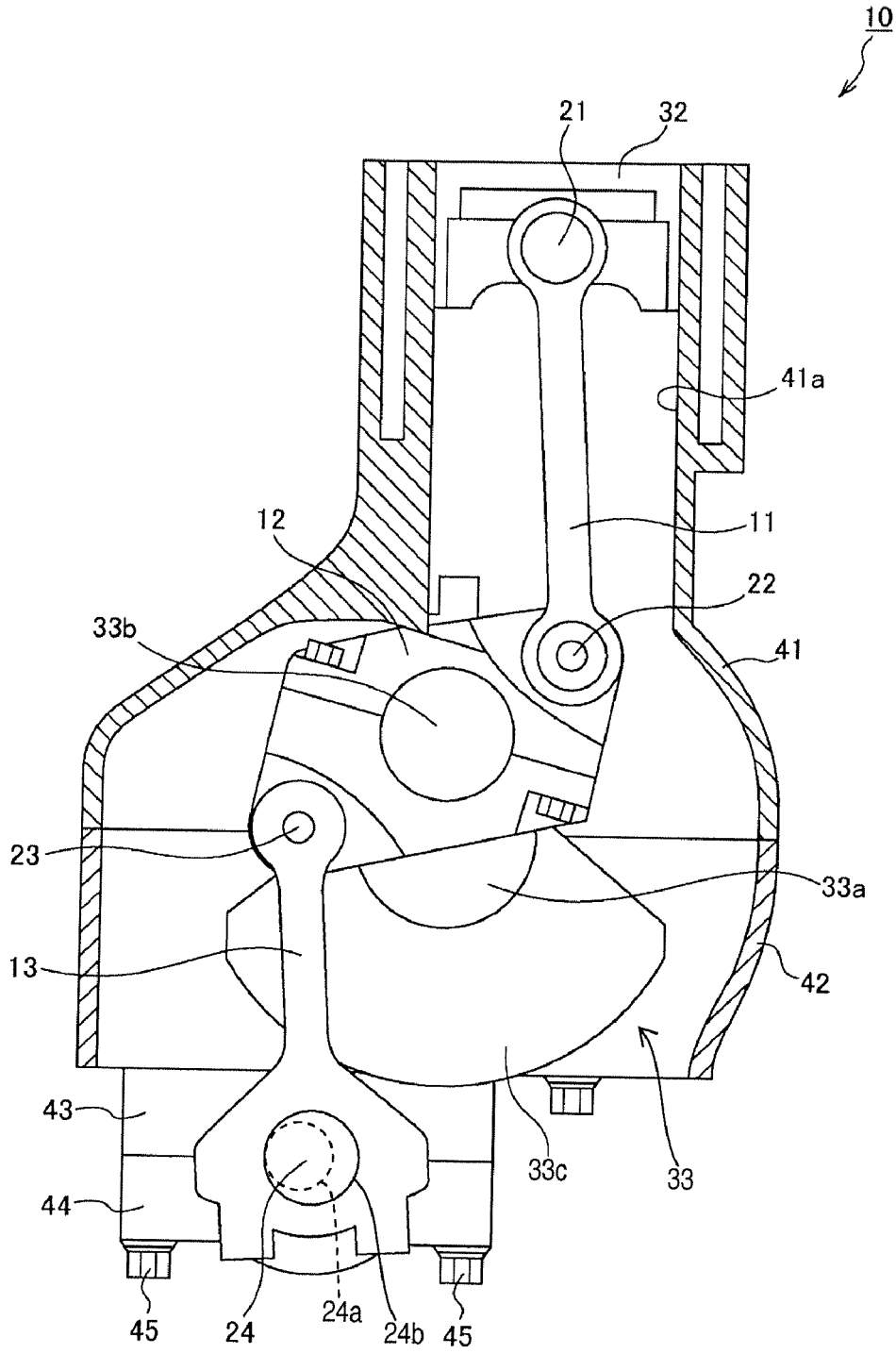
FIG. 1 is a vertical cross sectional view of a multi-link engine in accordance with one embodiment.

Referring initially to FIG. 1, selected portions of a multi-link engine 10 is illustrated in accordance with a preferred embodiment. The multi-link engine 10 has a plurality of cylinder. However, only one cylinder will be illustrated herein for the sake of brevity. The multi-link engine 10 includes, among other things, a linkage for each cylinder having an upper link 11, a lower link 12 connected to the upper link 11 and a control link 13 connected to the lower link 12. The multi-link engine 10 also includes a piston 32 for each cylinder and a crankshaft 33, which are connected by the upper and lower links 11 and 12.

In FIG. 1, the piston 32 of the multi-link engine is illustrated at bottom dead center. FIG. 1 is a cross sectional view taken along an axial direction of the crankshaft 33 of the engine 10. Among those skilled in the engine field, it is customary to use the expressions "top dead center" and "bottom dead center" irrespective of the direction of gravity. In horizontally opposed engines (flat engine) and other similar engines, top dead center and bottom dead center do not necessarily correspond to the top and bottom of the engine, respectively, in terms of the direction of gravity. Furthermore, if the engine is inverted, it is possible for top dead center to correspond to the bottom or downward direction in terms of the direction of gravity and bottom dead center to correspond to the top or upward direction in terms of the direction of gravity. However, in this specification, common practice is observed and the direction corresponding to top dead center is referred to as the "upward direction" or "top" and the direction corresponding to bottom dead center is referred to as the "downward direction" or "bottom."

Now the linkage of the multi-link engine 10, will be described in more detail. An upper end of the upper link 11 is connected to the piston 32 by a piston pin 21, while a lower end of the upper link 11 is connected to one end of the lower link 12 by an upper link pin 22. The other end of the lower link 12 is connected to the control link 13 with a control link pin 23. The piston 32 moves reciprocally inside a cylinder liner 41*a* of a cylinder block 41 in response to combustion pressure. In this embodiment, as shown in FIG. 1, the upper link 11 adopts an orientation substantially parallel to a center axis of the cylinder.

Still referring to FIG. 1, the crankshaft 33 is provided with a plurality of crank journals 33*a*, a plurality of crank pins 33*b*, and a plurality of counterweights 33*c*. The crank journals 33*a* are rotatably supported by the cylinder block 41 and a ladder frame 42. The crank pin 33*b* for each cylinder is eccentric relative to the crank journals 33*a* by a prescribed amount and the lower link 12 is rotatably connected to the crank pin 33*b*. The lower link 12 has a bearing hole located in its approximate middle. The crank pin 33*b* of the crankshaft 33 is disposed in the bearing hole of the lower link 12 such that the lower link 12 rotates about the crank pin 33*b*. The lower link 12 is constructed such that it can be divided into a left member and a right member (two members). The center of the upper link pin 22, the center of the control link pin 23 and the center of the crank pin 33*b* lie on the same straight line when viewed along an axial direction of the crankshaft 33. The reasoning for this positional relationship will be explained later. Preferably, two counterweights 33*c* are provided per cylinder.

The control link pin 23 is inserted through a distal end of the control link pin 13 such that the control link 13 is pivotally connected to the lower link 12. The other end of the control link 13 is arranged such that it can rock about a control shaft 24. The control shaft 24 is disposed substantially parallel to the crankshaft 33, and is supported in a rotatable manner on the engine body. The control shaft 24 comprises a shaft-controlling axle 24*a* and an eccentric pin 24*b*. The control shaft 24 is an eccentric shaft as shown in FIG. 1 with one end of the control link 13 connected to the eccentric pin 24*b* that is offset from a center rotational axis of the shaft-controlling axle 24*a*. In other words, the eccentric pin 24*b* is eccentric relative to the center rotational axis of the shaft-controlling axle 24*a* by a predetermined amount. The control link 13 oscillates or rocks in relation to the eccentric pin 24*b*. The shaft-controlling axle 24*a* of the control shaft 24 is rotatably supported by a control shaft support carrier 43 and a control shaft support cap 44. The control shaft support carrier 43 and the control shaft support cap 44 are fastened together and to the ladder frame 42 with a plurality of bolts 45. In this embodiment, the cylinder block 41, the ladder frame 42 and the control shaft support carrier 43 constitutes an engine block body. By moving the eccentric position of the eccentric pin 24*b*, the rocking center of the control link 13 is moved and the top dead center position of the piston 32 is changed. In this way, the compression ratio of the engine can be mechanically adjusted.

The control shaft 24 is positioned below the center of the crank journal 33*a*. The control shaft 24 is positioned on an opposite side of the crank journal 33*a* from the center axis of the cylinder. In other words, when an imaginary straight line is drawn which passes through the center axis of the crankshaft 33 (i.e., the crankshaft journal 33*a*) and which is parallel to the cylinder axis when viewed along an axial direction of the crankshaft, the control shaft 24 is positioned opposite of the center axis of the cylinder with respect to this imaginary straight line. In FIG. 1, the center axis of the cylinder is positioned rightward of the center axis of the crankshaft journal 33*a* and the control shaft 24 is positioned leftward of the center axis of the crankshaft journal 33*a*. The reason for arranging the control shaft 24 in such a position will be explained later.

Figure 2A:
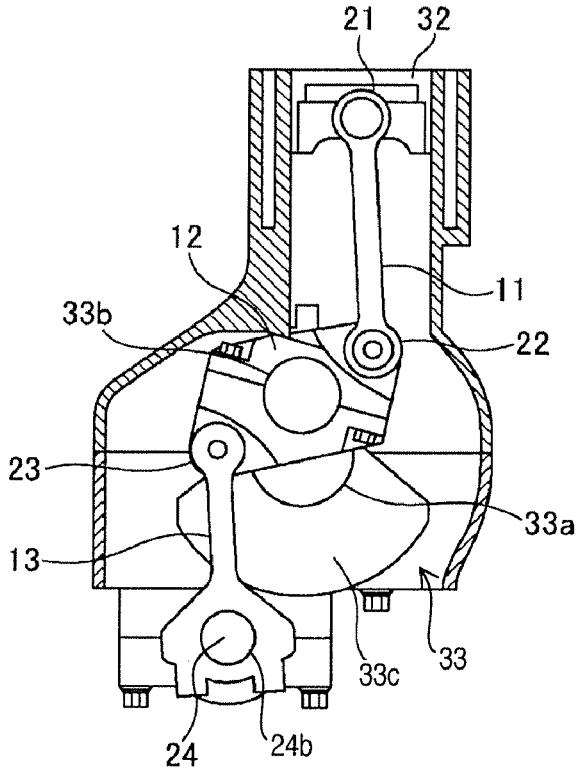
FIG. 2A is a longitudinal cross sectional view of the multi-link engine illustrated in FIG. 1 where the piston is at top dead center.
Figure 2B:
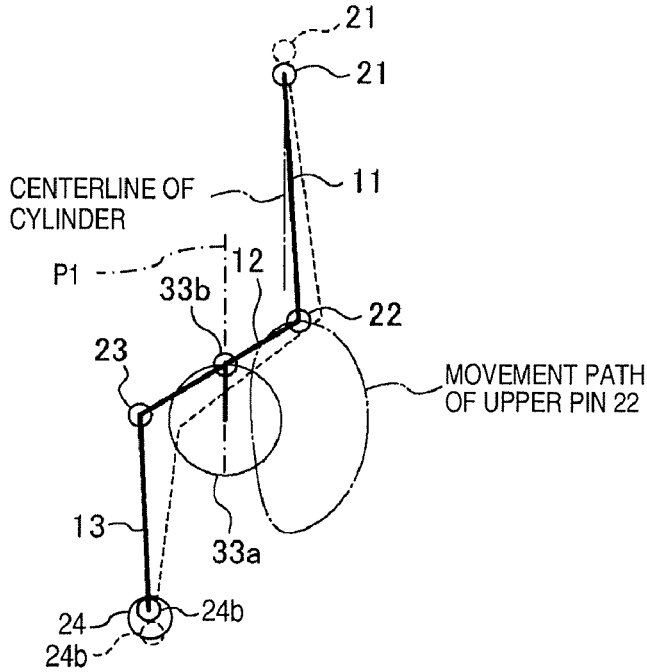
FIG. 2B is a link diagram of the multi-link engine illustrated in FIG. 2A where the piston is at top dead center.
Figure 3A:
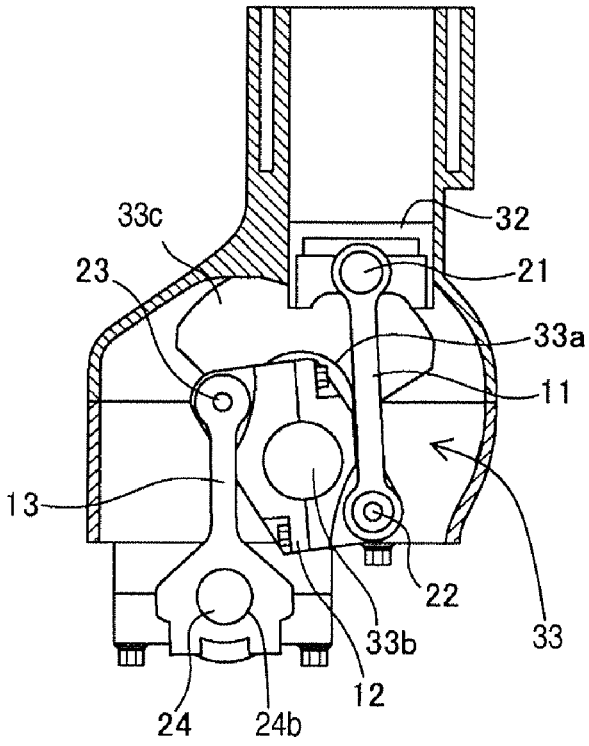
FIG. 3A is a cross sectional view of the multi-link engine illustrated in FIG. 1 where the piston is at bottom dead center.
Figure 3B:
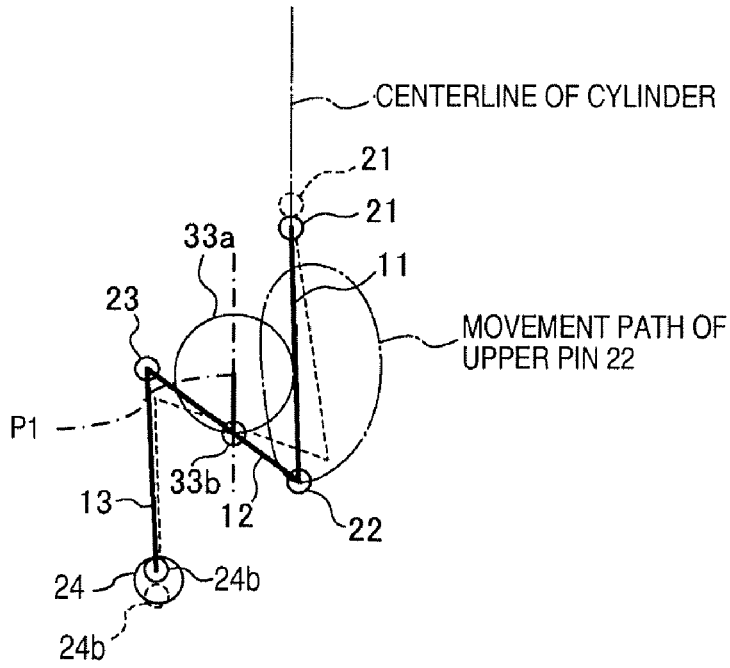
FIG. 3B is a link diagram of the multi-link engine illustrated in FIG. 3B where the piston is at bottom dead center.

FIGS. 2A and 2B show the engine 10 with the piston at top dead center. FIGS. 3A and 3B show the engine with the piston at bottom dead center. In FIGS. 2B and 3B, the solid line illustrates a geometry adopted when the engine is in a low compression ratio state and the broken line illustrates a geometry adopted when the engine is in a high compression ratio state.

The position of the control shaft 24 is arranged such that the center axis of the control link 13 is substantially vertical (preferably vertical) when the piston 32 is positioned at top dead center (FIGS. 2A and 2B) and such that the center axis of the control link 13 is substantially vertical (preferably vertical) when the position 32 is positioned at bottom dead center (FIGS. 3A and 3B). When viewed along an axial direction of the crankshaft 33, the center axis of the control link 13 lies on a straight line joining the center of the eccentric pin 24*b* of the control shaft 24 and the center of the control link pin 23.

Figure 4:
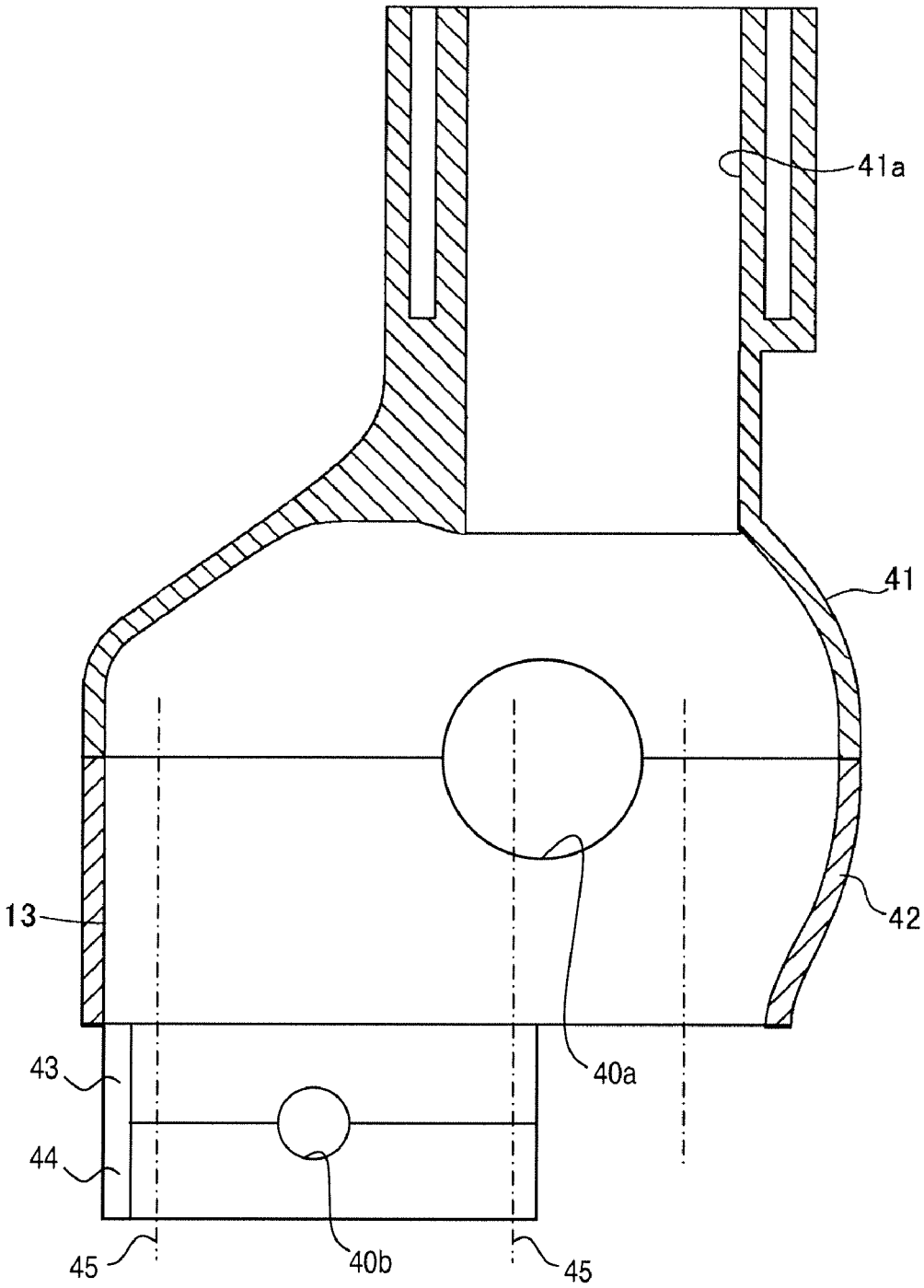
FIG. 4 is a vertical cross sectional view of the engine block of the multi-link engine illustrated in FIG. 1.

FIG. 4 is a longitudinal cross sectional view of the cylinder block 41. The ladder frame 42 is bolted to the cylinder block 41. A hole 40*a* is formed in the ladder frame 42 and the cylinder block 41 for rotatably supporting the crank journal 33*a* of the crankshaft 33. The center axes of the bolts fastening the ladder frame 42 and the cylinder block 41 together are perpendicular to this plane of contact. In other words, the center axes of the bolts are parallel to the center axis of the cylinder.

The control shaft support carrier 43 and the control shaft support cap 44 are fastened together and to the ladder frame 42 with the bolts 45. The center axis of the bolts 45 are indicated in FIG. 4 with single-dot chain lines. A hole 40*b* is formed by the control shaft support carrier 43 and the control shaft support cap 44 and the shaft-controlling axle 24*a* of the control shaft 24 is rotatably supported in the hole 40*b*. The plane of contact between the control shaft support carrier 43 and the ladder frame 42 intersects perpendicularly with the center axis of the cylinder. The plane of contact between the control shaft support cap 44 and the control shaft support carrier 43 also intersects perpendicularly with the center axis of the cylinder. The center axes of the bolts 45 intersect perpendicularly with these planes of contact. In other words, the center axes of the bolts 45 are parallel to the center axis of the cylinder.

Figure 5A:
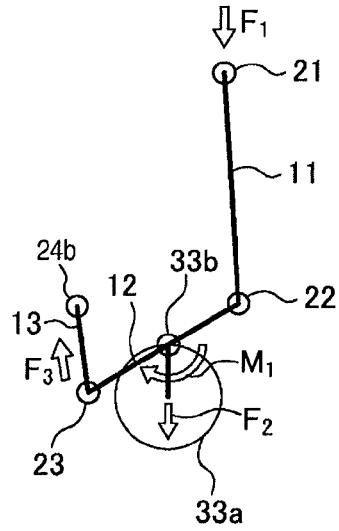
FIG. 5A is a link diagram for explaining the position in which the shaft-controlling axle of the control shaft is arranged.
Figure 5B:
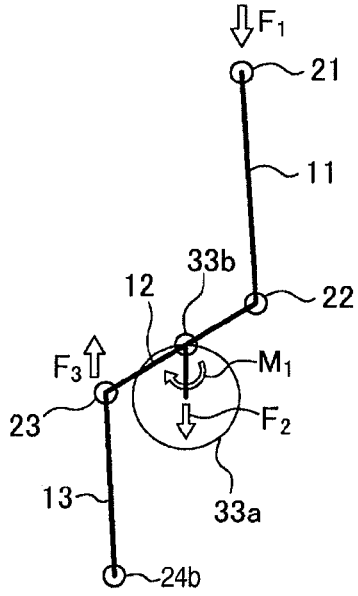
FIG. 5B is a link diagram for explaining the position in which the shaft-controlling axle of the control shaft is arranged.

FIGS. 5A and 5B show diagrams for explaining the position in which the control shaft 24 is arranged. FIG. 5A is a comparative example in which the control shaft 24 is arranged in a position higher than the crank journal 33*a*. FIG. 5B is illustrates the present embodiment, in which the control shaft 24 is arranged lower than the crank journal 33*a*. In this embodiment, as seen in FIGS. 2B and 3B, the control shaft 24 is positioned lower than the crank journal 33*a* (i.e., below a horizontal plane), with the control shaft 24 also being disposed on a first side of a plane P1 that is parallel to a cylinder center axis (centerline) of the cylinder liner 41*a* and that contains a center rotational axis of the crank journal 33*a*. The cylinder center axis (centerline) of the cylinder liner 41*a* is located on a second side of the plane P1. The reason for positioning the control shaft 24 in such a fashion will now be explained.

First, the comparative example shown in FIG. 5A will be explained to help the reader more readily understand the reasoning behind the position of the control shaft 24 in the embodiment.

It is possible to arrange the control shaft 24 in a position higher than the crank journal 33*a* as shown in FIG. 5A. However, the strength of the control link 13 becomes an issue when such a structure is adopted.

More specifically, the largest of the loads that will act on the control link 13 will be the load caused by combustion pressure. The load F1 resulting from the combustion pressure acts downward against the upper link 11. As a result of the downward load F1, a downward load F2 acts on a bearing portion of the crank journal 33*a* and a clockwise moment M1 acts about the crank pin 33*b*. Meanwhile, an upward load F3 acts on the control link 13 as a result of this moment M1. Thus, a compressive load acts on the control link 13. When a large compressive load acts on the control link 13, there is the possibility that the control link 13 will buckle. According to the Euler buckling equation shown as Equation (1) below, the buckling load is proportional to the square of the link length l.

Equation (1)

Euler buckling equation (1)

$$p_{cr} = n\pi^2 \frac{EI}{l^2}$$

Where

Pcr: buckling load n: end condition coefficient

E: longitudinal modulus of elasticity

I: second moment of inertia l: link length

Thus, the link cannot be made too long if bucking is to be avoided. In order to increase the link length l, it is necessary to increase the link width and link thickness so as to increase the second moment of inertia. This approach is not practical because of the resulting weight increase and other problems. Consequently, the length of the control link 13 must be short and the distance over which an end thereof (i.e., the control link pin 23) moves cannot be made to be long. Thus, the size of the engine cannot be increased and the desired engine output is difficult to achieve.

Conversely, in the present embodiment shown in FIG. 5B, the control shaft 24 is arranged lower than the crank journal 33*a*. In this way, the load F1 resulting from combustion pressure is transmitted from the upper link 11 to the lower link 12 and a tensile load acts on the control link 13. When a tensile load acts on the control link 13, the possibility of elastic failure of the control link 13 must be taken into consideration. Whether or not elastic failure will occur is generally believed to depend on the stress or strain of the link cross section and to be affected little by link length. Moreover, the maximum principle strain theory indicates that increasing the link length will decrease the strain resulting from a given tensile load and, thus, make the link less likely to undergo elastic failure.

Thus, since it is preferable to configure the link geometry such that the load resulting from combustion pressure is applied to the control link 13 as a tensile load, this embodiment arranges the control shaft 24 lower than the crank journal 33*a*.

Also, as explained previously, in this embodiment the center of the upper link pin 22, the center of the control link pin 23, and the center of the crank pin 33*b* are arranged on a single imaginary straight line. The reason for this arrangement will now be explained.

Figure 6A:
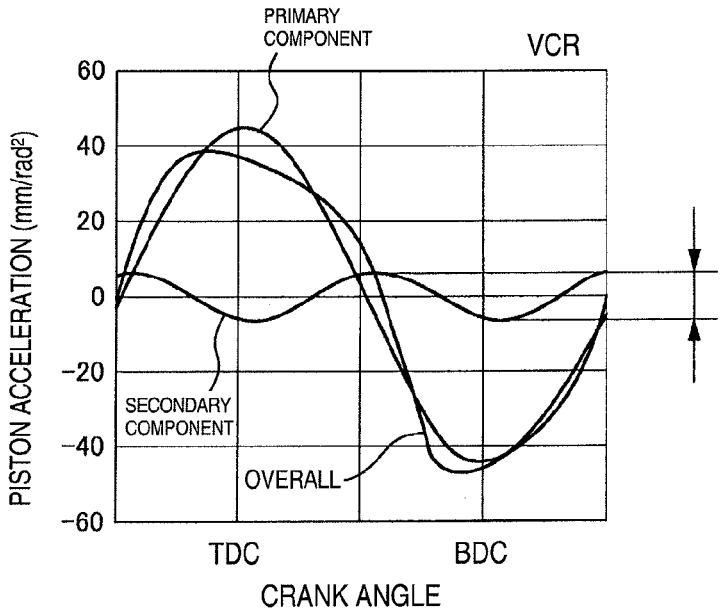
FIG. 6A is a graph that plots the piston acceleration versus the crank angle for explaining a piston acceleration characteristic of a variable compression ratio (VCR) multi-link engine.
Figure 6B:
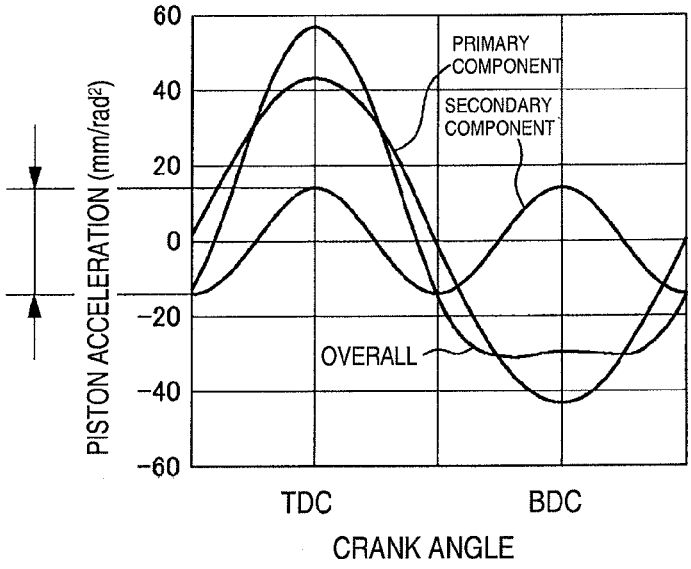
FIG. 6B is a graph that plots the piston acceleration versus the crank angle for explaining a piston acceleration characteristic of a conventional single-link engine.

According to analysis, a multi-link engine can be made to have a lower degree of vibration than a single-link engine by adjusting the position of the control shaft appropriately. The results of the analysis are shown in FIGS. 6A and 6B which shows diagrams comparing the piston acceleration characteristics for a multi-link engine to a single-link engine. FIG. 6A is a plot of piston acceleration characteristic curves versus the crank angle for a multi-link engine. FIG. 6B is a plot of piston acceleration characteristic curves versus the crank angle for a single-link engine as a comparative example. This is a comparison with a common single-link engine in which the ratio of the connecting rod length to the stroke is about 1.5 to 3. Assuming the upper link of the multi-link engine is equivalent to the connecting rod of the single-link engine, the comparison is made under the conditions that the stroke lengths are the same and that the upper link of the multi-link engine has the same length as the connecting rod of the single-link engine.

As shown in FIG. 6B, with the single-link engine, the magnitude (absolute value) of the overall piston acceleration obtained by combining a first order component and a second order component is small in a vicinity of bottom dead center than in a vicinity of top dead center. Conversely, as shown in FIG. 6A, with the multi-link engine the magnitude (absolute value) of the overall piston acceleration is substantially the same at both bottom dead center and top dead center. Additionally, the magnitude of the second order component is smaller in the case of the multi-link engine than in the case of the single-link engine, illustrating that the multi-link engine enables second order vibration to be reduced.

Figure 7A:
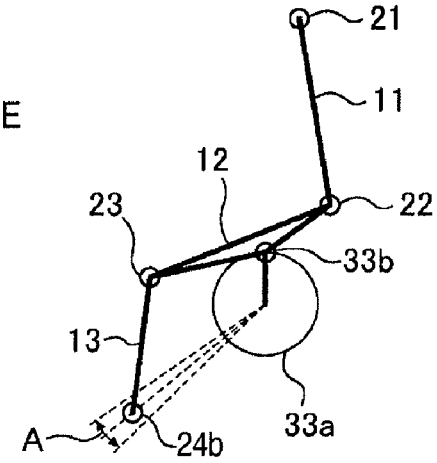
FIG. 7A is a link diagram for explaining positions in which the control shaft can be arranged in order to reduce a second order vibration.
Figure 7B:
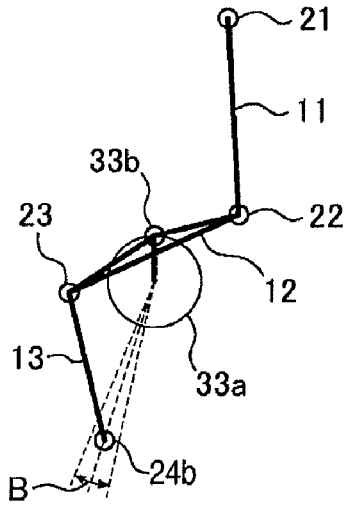
FIG. 7B is a link diagram for explaining positions in which the control shaft can be arranged in order to reduce a second order vibration.
Figure 7C:
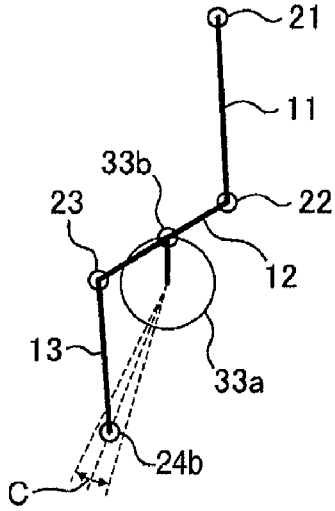
FIG. 7C is a link diagram for explaining positions in which the control shaft can be arranged in order to reduce a second order vibration.

As explained previously, the vibration characteristic of a multi-link engine can be improved (in particular, the second order vibration can be reduced) by positioning the control shaft appropriately. FIGS. 7A to 7C are diagrams for explaining positions where the control shaft can be arranged when the piston 32 is at top dead center in order to reduce the second order vibration. FIG. 7A shows a case in which the crank pin is positioned lower than a line joining the upper link pin 22 and the control link pin 23, FIG. 7B shows a case in which the crank pin 33*b* is positioned higher than a line joining the upper link pin 22 and the control link pin 23, and FIG. 7C shows a case in which the crank pin 33*b* is positioned on a line joining the upper link pin 22 and the control link pin 23.

When the crank pin 33*b* is positioned lower than a line joining the upper link pin 22 and the control link pin 23 as shown in FIG. 7A, the second order vibration can be reduced by positioning the control shaft 24 in the region indicated with the arrows A in the FIG. 7A. In order to use the control link 13 whose length has been set based on the required performance of the engine, the control shaft 24 is positioned leftward of the control link pin 23 (i.e., farther from the crank journal 33*a*).

When the crank pin 33*b* is positioned higher than a line joining the upper link pin 22 and the control link pin 23 as shown in FIG. 7B, the second order vibration can be reduced by positioning the control shaft 24 in the region indicated with the arrows B in the FIG. 7B. In order to use a control link 13 whose length has been set based on the required performance of the engine, the control shaft 24 is positioned rightward of the control link pin 23 (i.e., closer to the crank journal 33*a*).

When the crank pin 33*b* is positioned on a line joining the upper link pin 22 and the control link pin 23 as shown in FIG. 7C, the second order vibration can be reduced by positioning the control shaft 24 in the region indicated with the arrows C in the figure. In order to use a control link 13 whose length has been set based on the required performance of the engine, the control shaft 24 is positioned directly under the control link pin 23. In this embodiment, as explained previously, the control shaft 24 is positioned such that the center axis of the control link 13 is oriented substantially vertically (standing substantially straight up), and preferably vertically, when the piston 32 is positioned at top dead center and when the piston 32 is positioned at bottom dead center. In order to achieve such a geometry while also reducing the second order vibration, it is necessary to arrange the crank pin 33*b* on the line joining the upper link pin 22 and the control link pin 23.

Figure 8A:
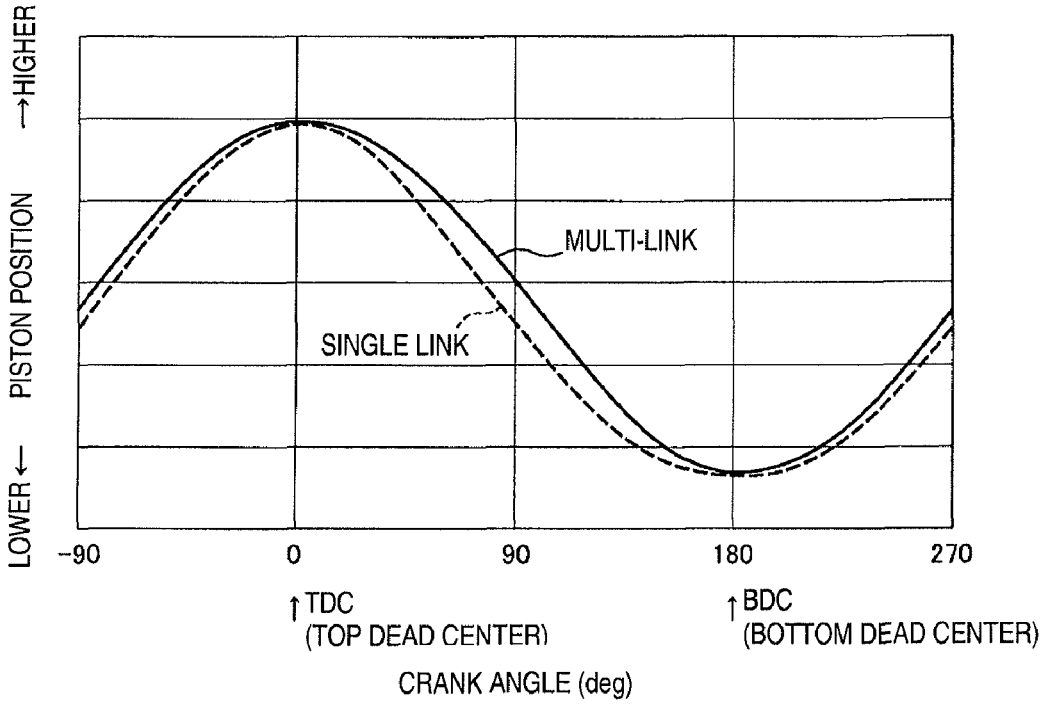
FIG. 8A is a graph that plots of the piston displacement versus the crank angle.
Figure 8B:
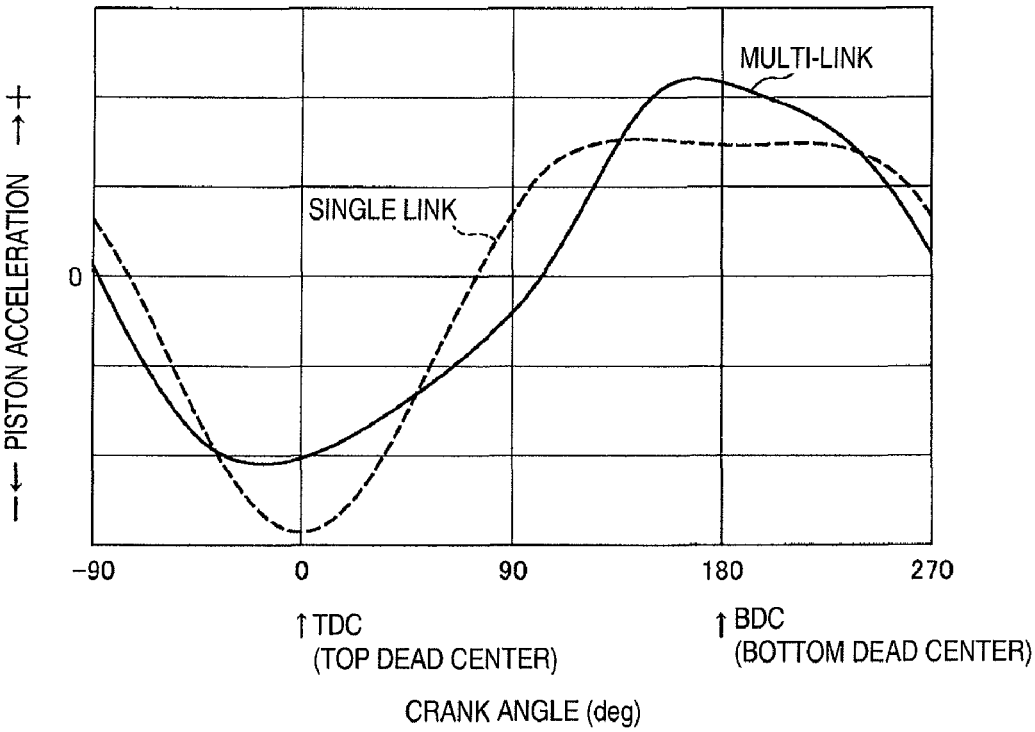
FIG. 8B is a graph that plots of the piston acceleration versus the crank angle.

FIGS. 8A and 8B show plots of the piston displacement and piston acceleration versus the crank angle. In a multi-link engine, even when the connecting rod ratio λ (=upper link length l/crank radius r) is not a large value but is a common value (e.g., 2.5 to 4), the amount of piston movement with respect to a prescribed change in crank angle is smaller than in a single-link engine when the piston is near top dead center and larger than in a single-link engine when the piston is near bottom dead center, as shown in FIG. 8A. The movement acceleration of the piston is as shown in FIG. 8B. Thus, the acceleration of the piston is smaller in a multi-link engine than in a single-link engine when the piston is near top dead center and larger in a multi-link engine than in a single-link engine when the piston is near bottom dead center, and the vibration characteristic of the multi-link engine is close to having a single component.

Figure 9A:
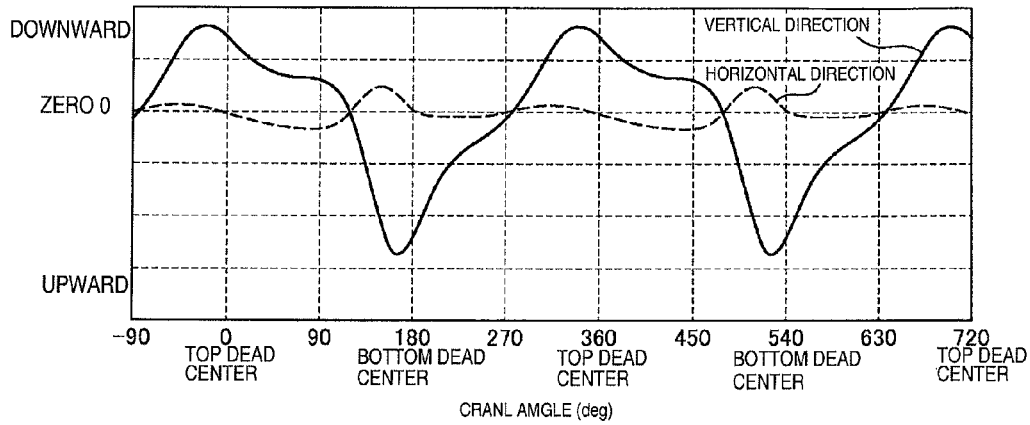
FIG. 9A is a graph that shows the fluctuation of load acting on a distal end of a control link (control shaft) from inertia in a multi-link engine having a link geometry in accordance with the illustrated embodiment.
Figure 9B:
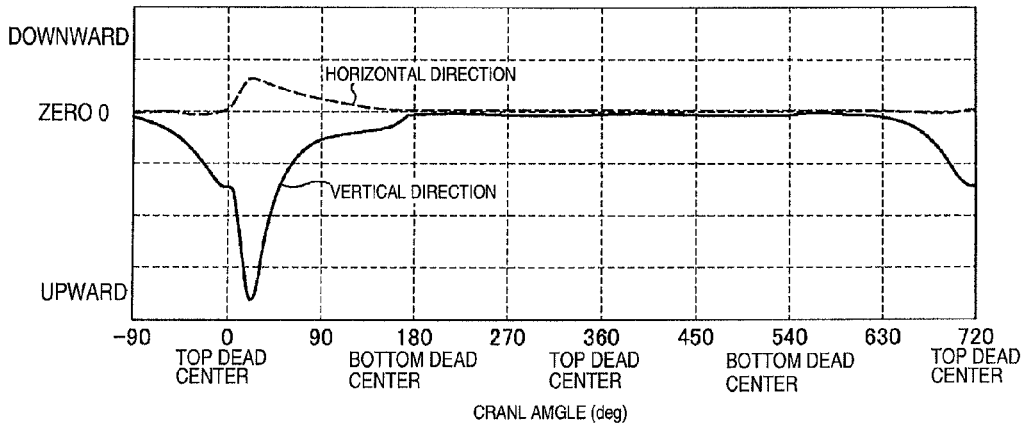
FIG. 9B is a graph that shows the fluctuation of load acting on a distal end of a control link (control shaft) from combustion pressure in a multi-link engine having a link geometry in accordance with the illustrated embodiment.
Figure 9C:
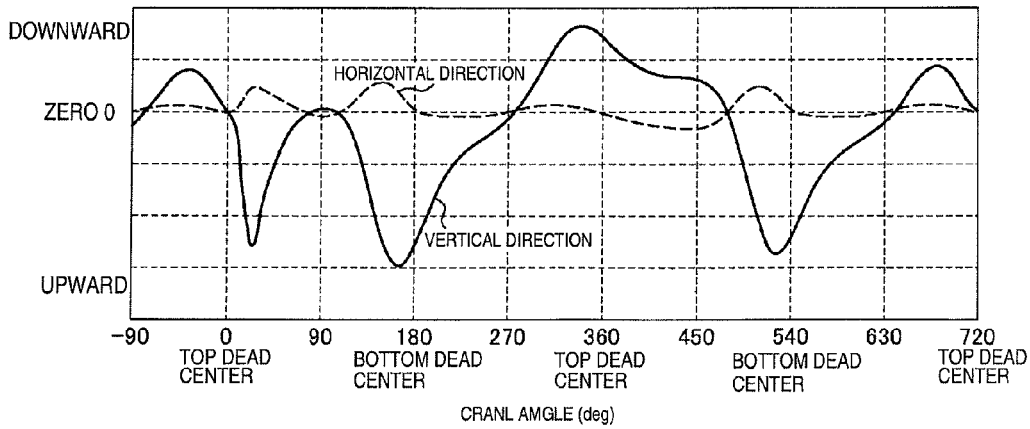
FIG. 9C is a graph that shows the fluctuation of a resultant load that combines the loads shown in FIGS. 9A and 9B acting on a distal end of a control link (control shaft) in a multi-link engine having a link geometry in accordance with the illustrated embodiment.

When such a link geometry is adopted, a force that fluctuates according to a 360-degree cycle acts on the distal end of the control link 13 due to an inertia force resulting from the acceleration characteristic of the piston 32 and is transmitted to the control shaft 24 of the multi-link engine 10 as shown in FIG. 9A. Additionally, a force that results from combustion pressure and fluctuates according to a 720-degree cycle acts on the distal end of the control link 13 and is transmitted to the control shaft 24 as shown in FIG. 9B. Thus, a resultant force (combination of the two forces) that fluctuates according to a 720-degree cycle acts on the distal end of the control link 13 and is transmitted to the control shaft 24 as shown in FIG. 9C.

These downward loads act to separate the control shaft support cap 44 from the control shaft support carrier 43 and there is the possibility that the control shaft support cap 44 will shift out of position relative to the control shaft support carrier 43 if a horizontally oriented load happens to act at the same time. In order counteract this possibility, it is necessary to increase the number of bolts 45 or to increase the size of the bolts 45 so as to achieve a sufficient axial force fastening the control shaft support carrier 43 and control shaft support carrier 44 together.

However, it has been observed that the size (magnitude) of the load acting on the control link 13 as a result of inertia forces and combustion pressure reaches a maximum when the piston is at top dead center and when the piston is at bottom dead center. In this embodiment, the link geometry of the multi-link engine is configured such that the control link 13 is oriented substantially vertically (preferably vertically) when the piston is at top dead center and when the piston is at bottom dead center. In this way, a horizontally oriented load can be prevented from acting on the distal end of the control link 13 and transmitted to the control shaft 24 when the magnitude of the load acting on the control link 13 is at a maximum and the control shaft support cap 44 can be prevented from shifting out of position relative to the rocking center support carrier 43.

As explained previously, by moving the eccentric position of the eccentric pin 24*b*, the rocking center of the control link 13 is moved and the top dead center position of the piston 32 is changed. In this way, the compression ratio of the engine can be mechanically adjusted. The compression ratio is preferably lowered when the engine 10 is operating under a high load. When the load is high, both sufficient output and prevention of knocking can be achieved by lowering the mechanical compression ratio and setting the intake valve close timing to occur near bottom dead center. It is also preferable to raise the compression ratio when the engine 10 is operating under a low load. When the load is low, the expansion ratio can be increased on the exhaust loss can be reduced by adjusting the intake valve close timing away from bottom dead center and adjusting the exhaust valve open timing to occur near bottom dead center. Since the load acting on the control link 13 increases during high load operation, the effect of preventing the control shaft support cap 44 from shifting out of place relative to the shaft-controlling axle support carrier 43 is exhibited more demonstrably when the line formed between the center axis of the control link 13 and the center axis of the cylinder is smaller than when the same angle is larger, i.e., when the link geometry is set for a lower compression ratio than when the link geometry is set for a higher compression ratio as indicated with a broken line in FIGS. 2B and 3B.

Although in the illustrated embodiment the control shaft 24 is supported with a control shaft support carrier 43 and a control shaft support cap 44 that are bolted together and to the ladder frame 42 with bolts 45, it is acceptable for the control shaft support carrier 43 to be formed as an integral part of the ladder frame 42. In such a case, the cylinder block 41 and the ladder frame 42 correspond to the engine block body.

In the illustrated embodiment, the control shaft 24 is arranged to be lower than the crank journal 33*a* of the crankshaft 33. The control shaft 24 is also disposed on a first side of a plane that is parallel to the center axis of the cylinder liner 41*a* and that contains a center rotational axis of the crank journal, while the center axis of the cylinder is located on a second side (i.e., opposite the first side) of the plane that is parallel to the center axis of the cylinder liner 41*a* and that contains a center rotational axis of the crank journal 33*a*. Also the control shaft 24 is rotatably supported between the engine block body and the control shaft support cap 44 that is fastened to the engine block body with the bolts 45. Also, a center axis of the control link 13 is substantially parallel to the center axis of the cylinder liner 41*a* when the piston 32 is near top dead center and when the piston 32 is near bottom dead center. As a result, when the magnitude of the load acting on the control link 13 is at a maximum, a horizontal (leftward or rightward) load does not act on the distal end of the control link 13 and the control shaft 24 and the control shaft support cap 44 can be prevented from becoming misalignment relative to the engine block body.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A multi-link engine comprising:

an engine block body including at least one cylinder;

a control shaft rotatably supported on the engine block body by a control shaft support cap that is fastened to the engine block body by at least one bolt, the control shaft support cap and the engine block body having mating contact surfaces that intersect perpendicularly with a center axis of the cylinder;

a crankshaft including a crank pin;

a piston operatively coupled to the crankshaft to reciprocally move inside the cylinder of the engine;

an upper link rotatably connected to the piston by a piston pin;

a lower link rotatably connected to the crank pin of the crankshaft and rotatably connected to the upper link by an upper link pin; and a control link rotatably connected at one end to the lower link by a control link pin and rotatably connected at another end to the control shaft, the control shaft being positioned lower than a crank journal of the crankshaft and disposed on a first side of a plane that is parallel to the center axis of the cylinder and that contains a center rotational axis of the crank journal, while the center axis of the cylinder is located on a second side of the plane with the first side of the plane being opposite from the second side of the plane, and the control link having a center axis that is parallel to the center axis of the cylinder and perpendicular to the mating contact surfaces of the control support cap and the engine block body when the piston is near top dead center and when the piston is near bottom dead center.

2. The multi-link engine as recited in claim 1, wherein the control shaft support cap is fastened to the engine block body by the bolt that has a center axis parallel to the center axis of the cylinder.

3. The multi-link engine as recited in claim 1, wherein the upper link, the lower link and the control link are arranged with respect to each other such that at least one of an upward load acting on the control shaft due to combustion pressure reaches a maximum when the piston is near top dead center and a downward load acting on the control shaft due to inertia reaches a maximum when the piston is near top dead center; and the upper link, the lower link and the control link are further arranged with respect to each other such that an upward load acting on the control shaft due to inertia reaches a maximum when the piston is near bottom dead center.

4. The multi-link engine as recited in claim 1, wherein the crank pin of the crankshaft is arranged on an imaginary straight line joining centers of the upper link pin and the control link pin.

5. The multi-link engine as recited in claim 1, wherein the upper link, the lower link and the control link are arranged with respect to each other such that a size of a relative maximum value of a reciprocal motion acceleration of the piston when the piston is near bottom dead center is equal to or larger than a size of a relative maximum value of a reciprocal motion acceleration of the piston when the piston is near top dead center.

6. The multi-link engine as recited in claim 1, wherein the multi-link engine is a variable compression ratio engine configured such that a compression ratio thereof can be changed in accordance with an operating condition by adjusting a position of an eccentric pin of the control shaft; and the upper link, the lower link and the control link are arranged with respect to each other to form an angle formed between a center of the control link pin and the center axis of the cylinder with the angle being smaller when the compression ratio is lower than when the compression ratio is higher.

7. The multi-link engine as recited in claim 1, wherein the upper link inclines in the same direction as the control link relative to the center axis of the cylinder when the piston is near bottom dead center.

* * * * *